US009497811B2

(12) United States Patent
Schijffelen et al.

(10) Patent No.: US 9,497,811 B2
(45) Date of Patent: Nov. 15, 2016

(54) LED DRIVER CIRCUIT

(71) Applicant: Power Research Electronics B.V., Breda (NL)

(72) Inventors: Jos H. Schijffelen, Breda (NL); Menno Kardolus, Duivendrecht (NL); Mark Gröninger, Venlo (NL); Dolf van Casteren, Eindhoven (NL)

(73) Assignee: Power Research Electronics B.V., Breda (NL)

( * ) Notice: Subject to any disclaimer, the term of this patent is extended or adjusted under 35 U.S.C. 154(b) by 0 days.

(21) Appl. No.: 14/774,823

(22) PCT Filed: Mar. 4, 2014

(86) PCT No.: PCT/EP2014/054112

§ 371 (c)(1),
(2) Date: Sep. 11, 2015

(87) PCT Pub. No.: WO2014/139829

PCT Pub. Date: Sep. 18, 2014

(65) Prior Publication Data

US 2016/0029451 A1 Jan. 28, 2016

(30) Foreign Application Priority Data

Mar. 12, 2013 (EP) ..... 13158806

(51) Int. Cl.
*H05B 33/08* (2006.01)

(52) U.S. Cl.
CPC ..... *H05B 33/0824* (2013.01); *H05B 33/083* (2013.01); *H05B 33/0809* (2013.01); *H05B 33/0815* (2013.01); *H05B 33/0884* (2013.01); *H05B 33/0887* (2013.01)

(58) Field of Classification Search
None
See application file for complete search history.

(56) References Cited

U.S. PATENT DOCUMENTS

| | | | | |
|---|---|---|---|---|
| 2010/0109570 | A1 | 5/2010 | Weaver | |
| 2013/0015768 | A1 | 1/2013 | Roberts et al. | |
| 2014/0265900 | A1* | 9/2014 | Sadwick | H05B 33/0803 315/200 R |

FOREIGN PATENT DOCUMENTS

| | | | |
|---|---|---|---|
| EP | 2290777 | A1 | 3/2011 |
| EP | 2315497 | A1 | 4/2011 |
| EP | 2458940 | A1 | 5/2012 |
| WO | 2008/068682 | A1 | 6/2008 |
| WO | 2011/158196 | A1 | 12/2011 |

OTHER PUBLICATIONS

Zhang et al., Single-Phase Three Level Boost Power Factor Correction Converter, p. 434-439.*

(Continued)

*Primary Examiner* — Dedei K Hammond
(74) *Attorney, Agent, or Firm* — Richard M. Goldberg

(57) ABSTRACT

An LED driver circuit includes at least one string (10) of LEDs (12) connected in series, and a power supply for converting a mains voltage (AC) into an output voltage ($U_{out}$) to be applied to the at least one string (10) of LEDs, in which the power supply includes a single-stage boost converter (14) adapted to directly convert the mains voltage (AC) into the output voltage ($U_{out}$).

10 Claims, 5 Drawing Sheets

(56) References Cited

OTHER PUBLICATIONS

J. Rodrigues et al. "Multilevel Inverters: A Survey of Topologies, Controls and Applications", IEEE Trans. Industrial Electronics, vol. 49, No. 4, Aug. 2002, pp. 724-738.

M.T. Zhang et al. "Single-Phase Three-Level Boost Power Factor Correction Converter", IEEE APEC 10th Annual, 1995, pp. 434-439.

J. Zhang et al. "Evaluation of Input Current in the Critical Mode Boost PFC Converter for Distributed Power Systems", IEEE APEC 16th Annual, 2001, pp. 130-136.

L. Huber et al. "Effect of Valley Switching and Switching-Frequency Limitation on Line-Current Distortions of DCM/CCM boundary Boost PFC Converters", IEEE Trans. Power Electronics, vol. 24, 2009, pp. 339-347.

J.R. Pinheiro et al. "Dual Output Three-Level Boost Power Factor Correction Converter with Unbalanced Loads", IEEE PESC, 27th Annual, 1996, p. 733-739.

* cited by examiner

LED DRIVER CIRCUIT

BACKGROUND OF THE INVENTION

The invention relates to an LED driver circuit comprising at least one string of LEDs connected in series, and a power supply for converting a mains voltage into an output voltage to be applied to said at least one string of LEDs.

More particularly, the invention relates to high power lighting applications such as industrial lamps, sport field lamps, street lamps and the like, wherein an array of a plurality of LEDs is powered by a common power supply.

Since the forward voltage of a single LED, typically in the order of magnitude of 1 to 5 V, is significantly smaller than the mains voltage of, e.g., 400 $V_{AC}$, 230 $V_{AC}$ or 110 $V_{AC}$, it is necessary to convert the mains voltage into an output voltage that is suitable for the LEDs. When a plurality of LEDs are connected in series, the output voltage should correspond to the sum of the forward voltages of the LEDs in the string.

Most conventional LED driver circuits comprise a plurality of strings which each have only a relatively small number of LEDs, so that the output voltage will be lower than the mains voltage. However, when a plurality of strings are connected in parallel to a common power supply, the output current must be relatively high, which leads into increased system losses, and additional measures must be taken to assure a correct current balance between the parallel LED strings. In general for each LED string a separate converter operated in a current mode is applied to regulate the LED current. In addition, these systems require numerous connections and interconnection wires, so that the costs for the electronic components and their installation are relatively high.

EP 2 315 497 A1 and EP 2 458 940 A1 describe LED driver circuits which have a two-stage power supply. The first stage is a converter with a power factor correction function which converts the AC mains voltage into a DC voltage and assures compliance with the AC grid regulations. The second stage is a driver that regulates the current in the LED string or strings.

SUMMARY OF THE INVENTION

It is an object of the invention to provide an LED driver circuit with increased system efficiency and reduced system costs.

In order to achieve this object, according to the invention, the power supply includes a single-stage boost converter adapted to directly convert the mains voltage into the output voltage.

Since the mains voltage is boosted to a higher voltage level, the efficiency is improved and system losses are reduced. Moreover, the output current is relatively low, so that the electronic components on the output side of the power supply need only be designed for low currents. Preferably, the output voltage will exceed even the peak value of the applied mains voltage. This implies that sufficient insulation of the entire system is necessary. As a consequence, however, the conventional galvanic insulation of the LED driver (or transformer) may be dispensed with.

More specific optional features of the invention are indicated in the dependent claims.

In a preferred embodiment, the boost converter is a multi-level converter, e.g. of a type as generally described in an article by J. Rodrigues, J. S. Lai, F. Zheng, "Multilevel Inverters: A Survey of Topologies, Controls and Applications", IEEE Trans. Industrial Electronics, vol. 49, 2002, pages 724-738, and in an article by M. T. Zhang, J. Yiming, F. C. Lee, M. M. Jovanovic, "Single-Phase Three-Level Boost Power Factor Correction Converter", IEEE APEC 10th annual, 1995, pages 434-439. This topology permits to raise the output voltage level without using expensive high voltage rated semiconductor devices. For example, the output voltage may be raised to at least 1.5 times the peak value of the mains voltage. Preferably, the output voltage is evenly divided over a series connection of LED strings.

In order to increase the efficiency, it is preferable to operate the converter in the critical discontinuous mode, as has been described by J. Zhang, J. Shao, P. Xu, F. C. Lee, "Evaluation of Input Current in the Critical Mode Boost PFC Converter for Distributed Power Systems", IEEE, APEC 16th annual, 2001, pages 130-136, and L. Huber, B. T. Irving, M. M. Jovanovic, "Effect of valley switching and switching-frequency limitations on a line-current distortions of DCM/CCM boundary boost PFC converters", IEEE Trans. Power Electronics, vol. 24, 2009, pages 339-347. Additionally the cycle-by-cycle control can be simplified by applying a constant ON time of the electronic switches over the sine wave period of the mains voltage.

The multi-level topology has the further advantage that it enables a LED current balance control, whereby the efficiency can be raised even further. (J. R. Pinhiero, D. L. R. Vidor, H. A. Gründling, "Dual Output Three-Level Boost Power Factor Correction Converter with Unbalanced Loads", IEEE PESC, 27th annual, 1996, pages 733-739).

In a preferred embodiment, the converter is protected against excessive inrush currents and transient voltages.

BRIEF DESCRIPTION OF THE DRAWINGS

Embodiment examples of the invention will now be described in conjunction with the drawings, wherein.

DETAILED DESCRIPTION

Figure 1:
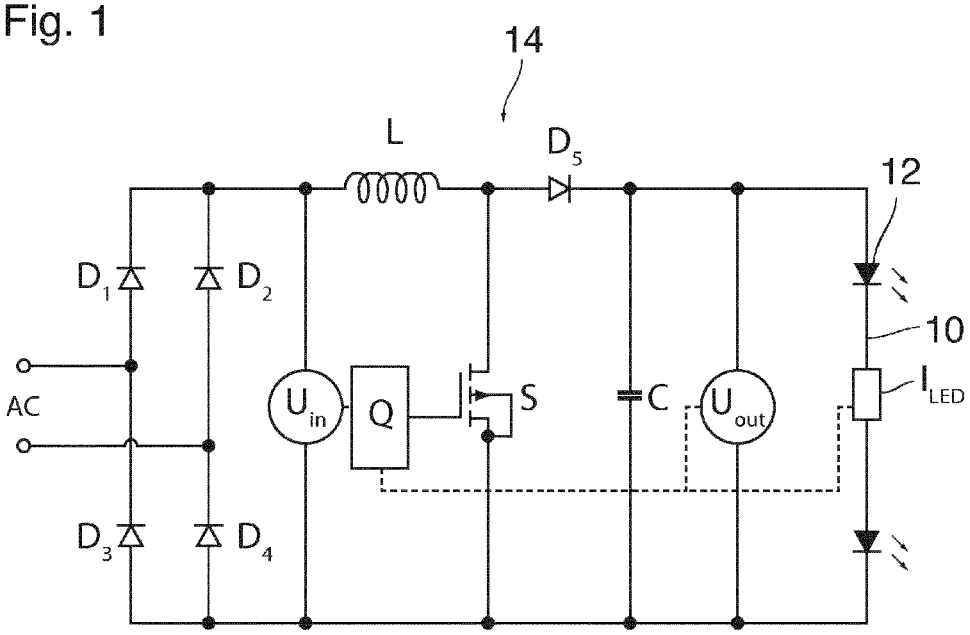
FIG. 1 is a circuit diagram of a simple example of an LED driver circuit according to the invention.

As is shown in FIG. 1, an LED driver circuit comprises a string 10 of LEDs 12 that are connected in series, and a single-stage boost converter 14 adapted to convert a mains voltage AC into an output voltage $U_{out}$ that is directly applied to the string 10. The mains voltage may for example be a single phase AC voltage of 230V.

Although, for simplicity, only two LEDs 12 have been shown in the string 10 in FIG. 1, the string will in practise comprise a significantly larger number of LEDs connected in series. For example, the number of LEDs may be as large as 100 or more, so that the output voltage $U_{out}$ may be in the order of magnitude of 400V to 1000V.

The converter 14 comprises a diode bridge formed by diodes $D_1$-$D_4$, and a series connection of an inductor L, a diode $D_5$ and a capacitor C connected between the output terminals of the diode bridge. An electronic switch S (e.g. a MOSFET) which is controlled by an electronic controller Q is connected in parallel to the diode D5 and the capacitor C. The string 10 of LEDs is connected in parallel to the capacitor C.

The diode bridge $D_1$-$D_4$ rectifies the mains voltage AC into a pulsating DC voltage $U_{in}$. When the switch S is ON (closed), the voltage $U_{in}$ drops across the inductor L, so that a current through the inductor L increases (positive slope). The diode $D_5$ prevents the capacitor C from being discharged via the switch S. As long as the switch S is on, an increasing amount of energy is stored in the inductor L while the capacitor C discharges via the LED string 10.

When the switch S is switched OFF (opened), the inductor L forces a current to flow through the diode $D_5$ and through the LED string 10 while the capacitor C is being recharged. Because the output voltage $U_{out}$ is always larger than the voltage $U_{in}$ or, more precisely, the instantaneous value of the time-dependent voltage $U_{in}$, the current flow through the inductor L decreases (negative slope) until the switch S is closed again.

A current shunt is provided for measuring the current $I_{LED}$ flowing through the LED string 10. The controller Q receives measured values of the current $I_{LED}$, input voltage $U_{in}$ and of the current flowing through the inductor L (and optionally, for protection purposes, of the output voltage $U_{out}$) and may be configured to feedback control the ON time of the switch S on a time scale that is large compared to the mains sine wave period, whereas the OFF times are controlled such that the current flowing through the inductor L has just time enough to decay to zero. In other words, the converter is operated in the so-called critical mode on the border between a continuous conduction mode (CCM) in which a current would flow continuously through the inductor L and a discontinuous conduction mode (DCM) in which there would be periods with no current flowing through the inductor.

Thus, the difference between the instantaneous values of $U_{out}$ and $U_{in}$ will determine the duration of the off periods of the switch S and hence, in conjunction with the duration of the ON time of the switch, the switching frequency of the converter. In general, the ON times of the switch S (constant or not) will be selected such that the switching frequency is in the order of magnitude of several kHz, so that an efficient power conversion can be achieved with an inductor with relatively low inductivity.

Figure 2:
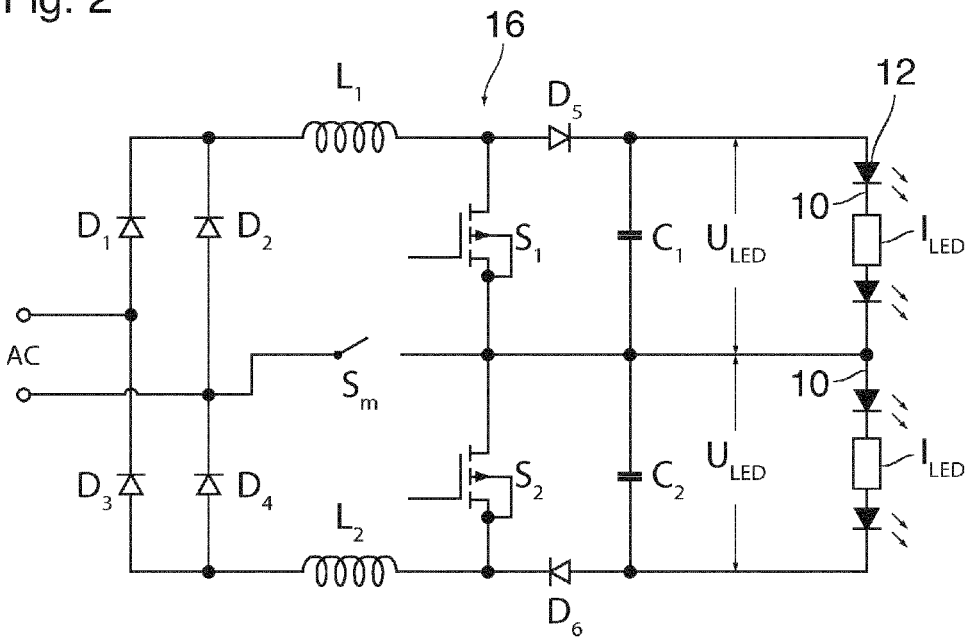
FIG. 2 is a circuit diagram of a driver circuit with a two-level converter.

As a more practical example, FIG. 2 illustrates the concept of a two-level converter 16 powering two LED strings 10 that are connected in series. If the two strings 10 have equal numbers of LEDs 12 and all LEDs have identical forward voltages, then the output voltage $U_{out}$ of the converter 16 will be evenly divided over the two strings 10, so that each string is powered with a terminal voltage $U_{LED}$ ($=U_{out}/2$).

The main difference between the converter 16 shown in FIG. 2 and the converter 14 shown in FIG. 1 is that, in the converter 16, the switch S is replaced by a series connection of two switches $S_1$, $S_2$, and the capacitor C is replaced by a series connection of capacitors $C_1$ and $C_2$. The mid-point between the switches and the capacitors forms a terminal that is connected to the mid-point between the two LED strings 10. Thus, the terminal voltage $U_{LED}$ for each string 10 is determined by the voltage drop across the corresponding capacitor $C_1$, $C_2$. An additional diode $D_6$ prevents the capacitor $C_2$ from being discharged via the switch $S_2$ when it is closed. the currents $I_{LED}$ flowing through each LED string 10 are measured individually.

In the example shown, the inductor L has also been replaced by two inductors $L_1$ and $L_2$. Moreover, a mode selector switch $S_m$ is connected between the mid-point of the diodes $D_2$ and $D_4$ and the mid-point between the switches $S_1$ and $S_2$.

When the mode selector switch $S_m$ is open and the switches $S_1$ and $S_2$ are operated synchronously (by the controller Q which has not been shown in FIG. 2), the operation of the converter 16 is equivalent to the operation of the converter 14. For example, by controlling the ON time of the switches $S_1$ and $S_2$, the output voltage $U_{out}$ may be controlled in the range from 400 V to 500 V, so that each individual string 10 will be powered with a terminal voltage $U_{LED}$ of a value between 200 V and 250 V.

The mode selector switch $S_m$ may be used to switch the converter into a voltage doubling mode in which the same output voltage $U_{out}$ with almost the same conversion efficiency can be achieved with a lower mains voltage of only 110 $V_{AC}$, for example. In this mode, i.e. when the switch $S_m$ is closed, the inductor $L_1$, the switch $S_1$ and the capacitor $C_1$ form a first converter (with only half the total inductivity) powered via the diode $D_1$ during the positive half wave of the mains voltage, and the inductor $L_2$, the switch $S_2$ and the capacitor $C_2$ form a second converter powered via the diode $D_3$ during the negative half wave of the mains voltage. Due to the reduced inductivity, each converter will convert the reduced mains voltage of 110V into a voltage $U_{LED}$ of 200 V-250 V, so that the total output voltage $U_{out}$ ($=2\ U_{LED}$) will still be 400 V to 500 V.

Figure 3:
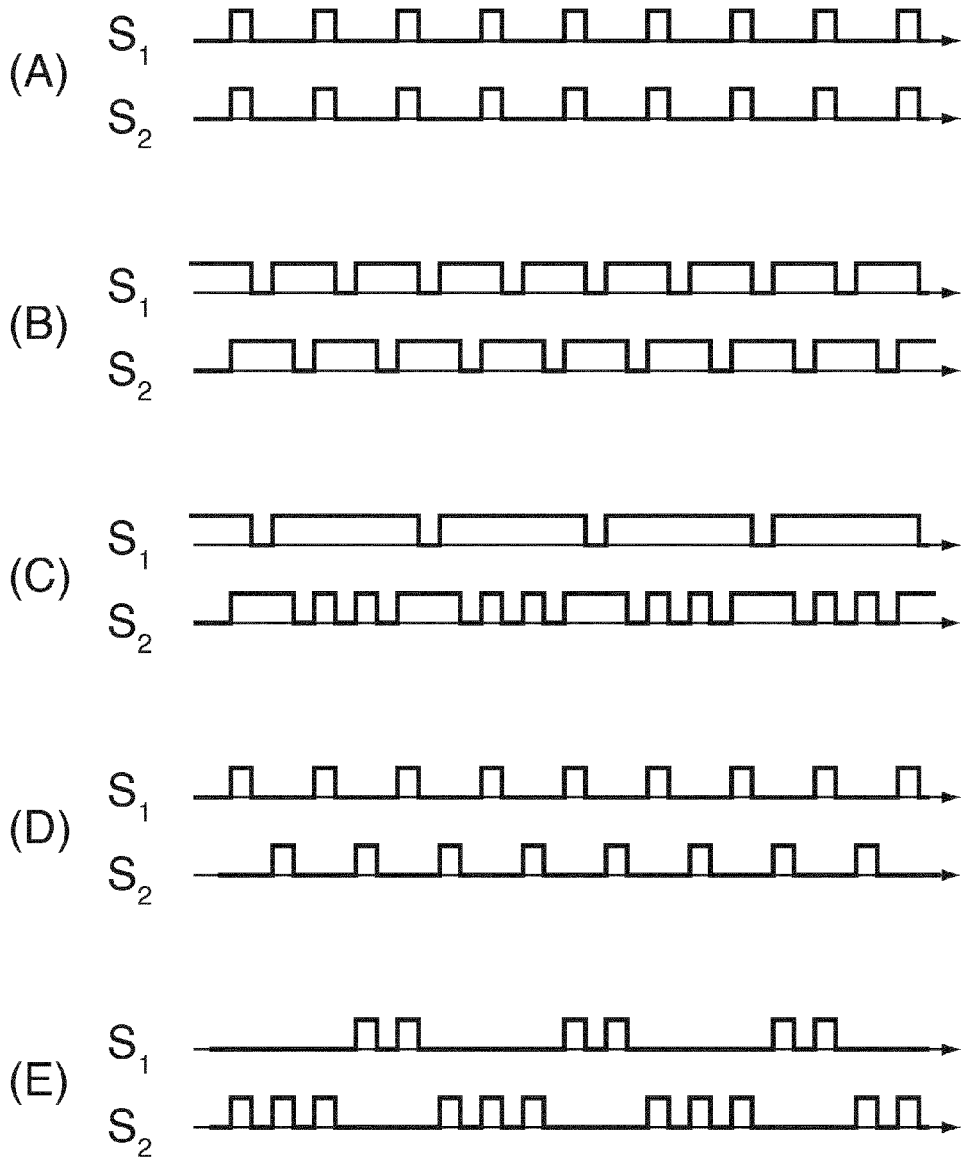
FIGS. 3(A)-(E) are time diagrams illustrating different modes of operation of the converter shown in FIG. 2.

In the normal mode (no voltage doubling), the two-level topology according to FIG. 2 has the advantage that the two switches $S_1$ and $S_2$ may be controlled independently of one another so as to achieve further improvements in efficiency and enable current balancing, as will now be explained in conjunction with FIG. 3.

FIG. 3(A) illustrates a switching pattern in witch both switches $S_1$ and $S_2$ are switched simultaneously, so that the effect is the same as would be achieved with the single switch S shown in FIG. 1. This mode is most efficient when the (instantaneous) input voltage $U_{in}$ is approximately equal to the terminal voltage $U_{LED}$.

However, when $U_{in}$ is smaller than $U_{LED}$, it is more efficient to use a switching pattern as shown in FIG. 3(B), wherein the switches $S_1$ and $S_2$ are operated alternatingly. In this pattern, the ON time is larger than the OFF time, so that there are time intervals in which the ON times of both switches overlap. In these time intervals, a current flows through both inductors $L_1$ and $L_2$ and through both switches $S_1$ and $S_2$, and the slope of this current is positive, i.e. the current increases. Simultaneously, the capacitors $C_1$ and $C_2$ discharge via the LED strings 10.

Then, the switch $S_1$ is switched OFF while switch $S_2$ remains ON. Consequently, the current through $L_1$ is forced to charge $C_1$ and/or to flow through the upper string 10 and then through the switch $S_2$ and inductor $L_2$. The slope of the current through $L_1$ is negative because $U_{LED}$ is larger than $U_{in}$.

When the current has dropped to zero (critical mode), $S_1$ is switched ON again, so that the current will rise again. Then, when switch $S_2$ is switched OFF, $S_1$ remains ON, so that, now, the current flowing through $L_1$ is forced to flow towards capacitor $C_2$ and the lower string 10 before returning via $L_2$. The slope will be negative again because the voltage $U_{LED}$ dropping across the capacitor $C_2$ is also larger than $U_{in}$.

This switching pattern has the advantage that the overall losses, including switching losses, are reduced under conditions in which instantaneous value of $U_{in}$ is smaller than $U_{LED}$.

In the example shown in FIG. 3(B), the duty cycles of the two switches are balanced, resulting in balanced terminal voltages across the two LED strings 10. It is possible however to modify the current balance between the two strings by modifying the duty cycles of the switches. For example, FIG. 3(C) illustrates a case where the average ON time of switch $S_1$ is larger than that of switch $S_2$. This pattern may be used for controlling the current balance between the two LED strings 10. Still, as in FIG. 3(B), this pattern fulfils the condition that there are periods in which both switches are ON and periods in which only one switch is ON but no periods in which both switches are OFF.

FIGS. 3(D) and (E) illustrate switching patterns that are more efficient when the instantaneous value of $U_{in}$ is larger than $U_{LED}$. In this case, the overall losses, including switching losses, can be minimized by fulfilling the condition that the ON times of the two switches never overlap, so that there are only periods in which a single switch is ON and periods in which no switch is ON. Since $U_{in}$ is larger than $U_{LED}$, the current slope will be positive when one switch is ON and the other switch is OFF, and, because $U_{in}$ is still smaller than $U_{out}=2\ U_{in}$, it will be negative only when both switches are OFF. FIG. 3(D) illustrates the case where the duty cycles of the two switches are balanced, whereas FIG. 3(E) illustrates an example wherein the duty cycles of the two switches are unbalanced in order to control the current balance of the LED strings 10.

The embodiments that have been described above may be modified in various ways, as will now exemplified in conjunction with FIGS. 4 to 7. It will be understood that all the features shown in these figures may be combined with one another and with the embodiments described previously.

Figure 4:
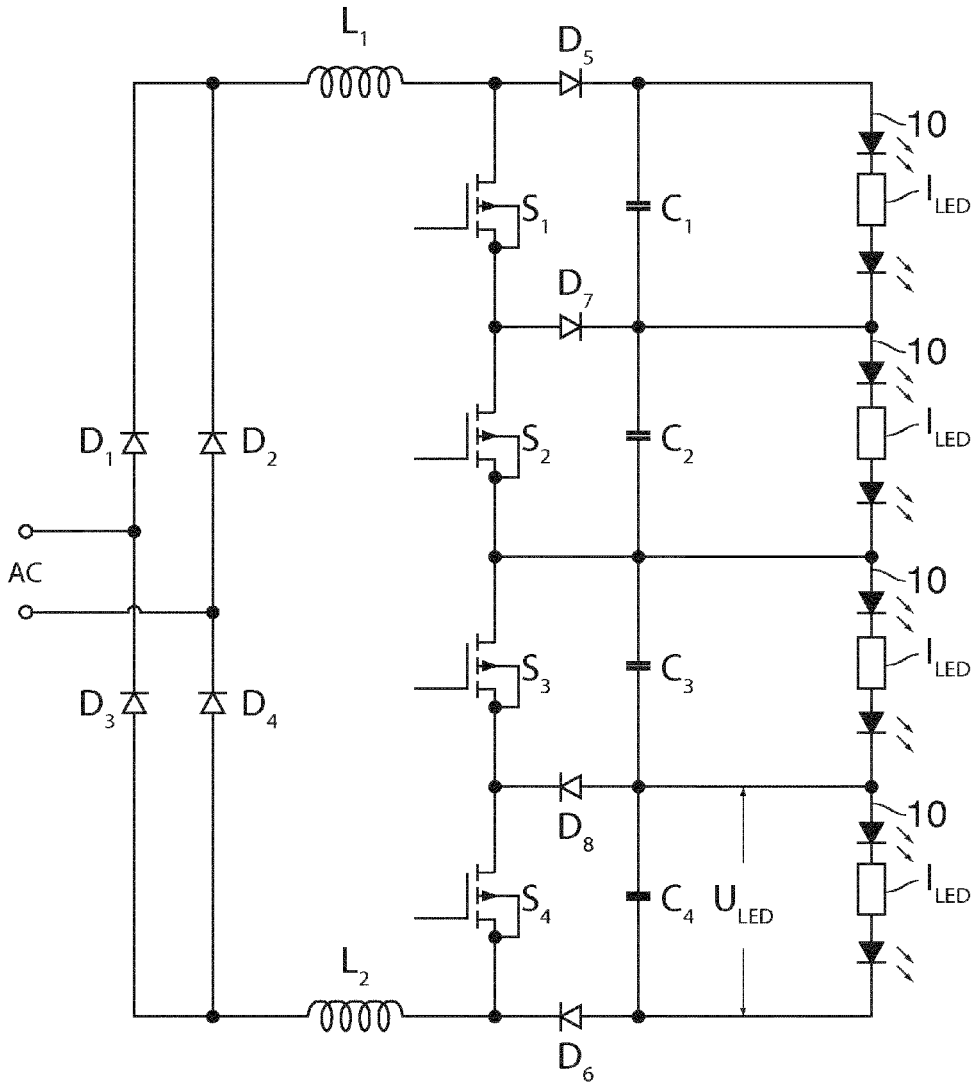
FIG. 4 is a circuit diagram of a four-level converter.
Figure 5:
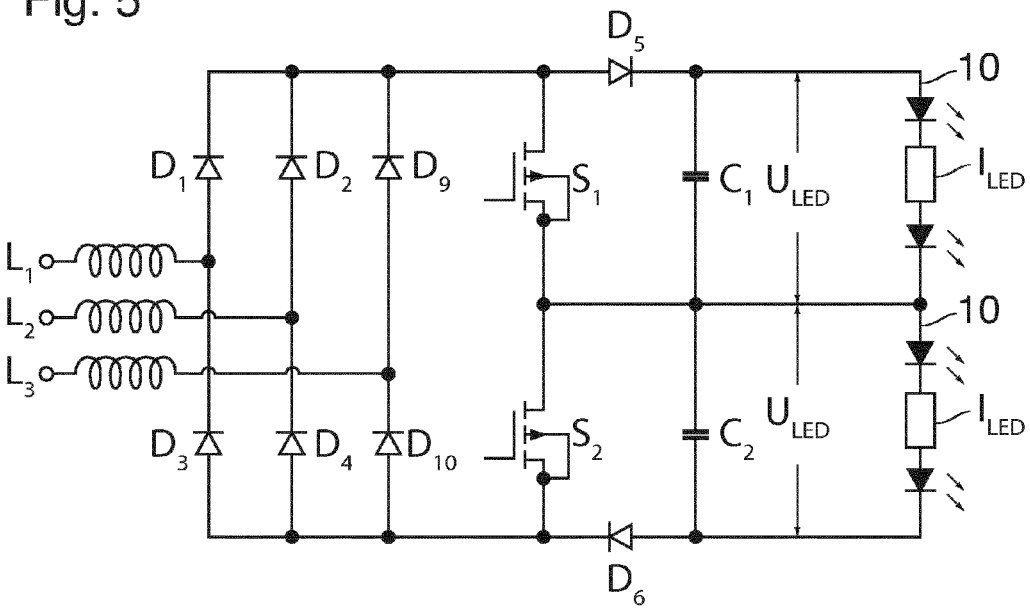
FIG. 5 is an example of a two-level converter adapted to three-phase mains voltage.

In FIG. 4, the concept of a multi-level converter has been extended to four levels. Each level is associated with a switch and a capacitor so that there are four switches $S_1$-$S_4$ and four capacitors $C_1$-$C_4$ in this embodiment. Further, two additional diodes $D_7$ and $D_8$ are provided for the two additional levels. The function principle is analogous to what has been described in conjunction with FIGS. 2 and 3. The voltage drop across the capacitor of an individual level and across the corresponding string 10 of LEDs is $U_{LED}$, so that the total output voltage across the series connection of all four capacitors $C_1$-$C_4$ will be four times $U_{LED}$ in this case. While $U_{LED}$ may be equal to or smaller than the peak value of the rectified mains voltage, the total output voltage $U_{out}$ will be larger then this peak value.

In this embodiment, the voltage drop across the inductors $L_1$ and $L_2$ may be modified step-wise by closing one, two, three or all four of the switches $S_1$-$S_4$. For control purposes, the LED currents $I_{LED}$ flowing through each LED string 10 may be measured individually (just as in FIG. 2).

FIG. 5 shows again a two-level converter which, in this case, is adapted to a three-phase mains voltage. The three phases of the mains voltage are applied to three inductors $L_1$, $L_2$ and $L_3$, the other ends of which are connected to the mid-points between respective diode pairs $D_1$ and $D_3$, $D_2$ and $D_4$, and $D_9$ and $D_{10}$ which will provide the rectified mains voltage. The line-to-line voltage of the three phase mains is 400 $V_{AC}$. the peak value equals 566 $V_{tt}$. Again, the terminal voltage $U_{LED}$ of a single level may be equal to or smaller than this peak voltage, whereas the total output voltage will be larger than the peak voltage.

This topology has the advantage that the capacitance of the capacitors $C_1$-$C_4$ which is needed as energy buffer may be smaller, so that electrolytic capacitors may be replaced by film capacitors which have an increased lifetime and are advantageous in applications with a high ambient temperature. In principle, this topology can be extended to even more levels, e.g. 8 or 16 levels.

Figure 6:
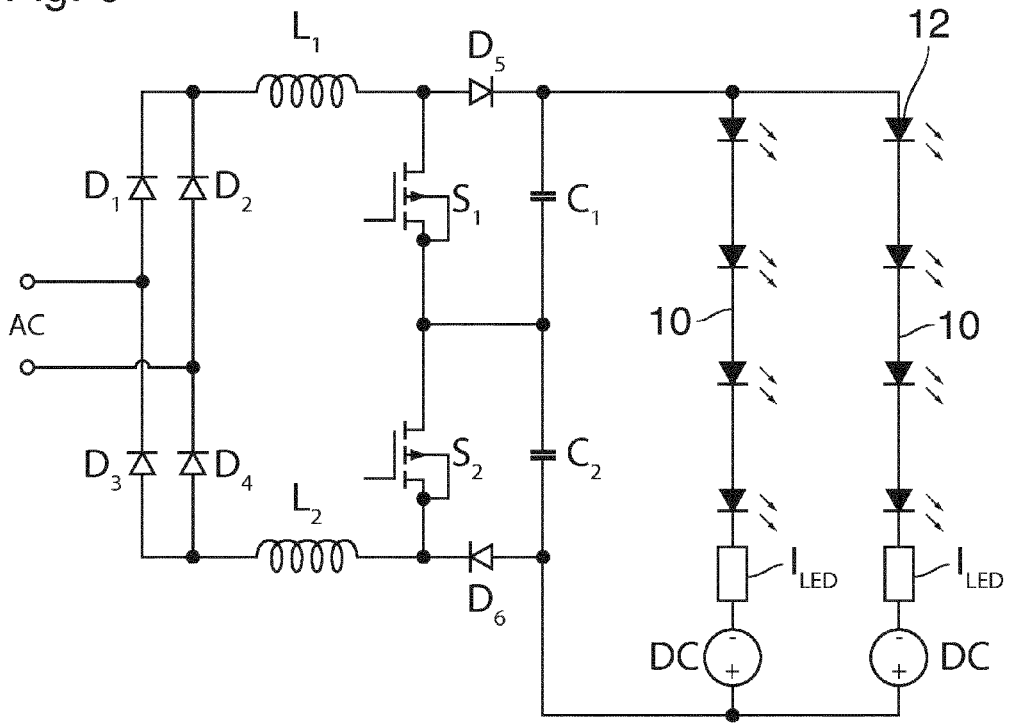
FIG. 6 is an example of an LED-driver circuit with two parallel LED strings.

FIG. 6 illustrates an embodiment that differs from FIG. 2 in that two parallel strings 10 of LEDs 12 are connected to the output of the converter. In order to be able to correct any possible unbalance between the two LED strings 10, each string includes a stabilized (optionally controllable) DC power supply (DC) that may be used to compensate for forward voltage differences between both LED strings.

Figure 7:
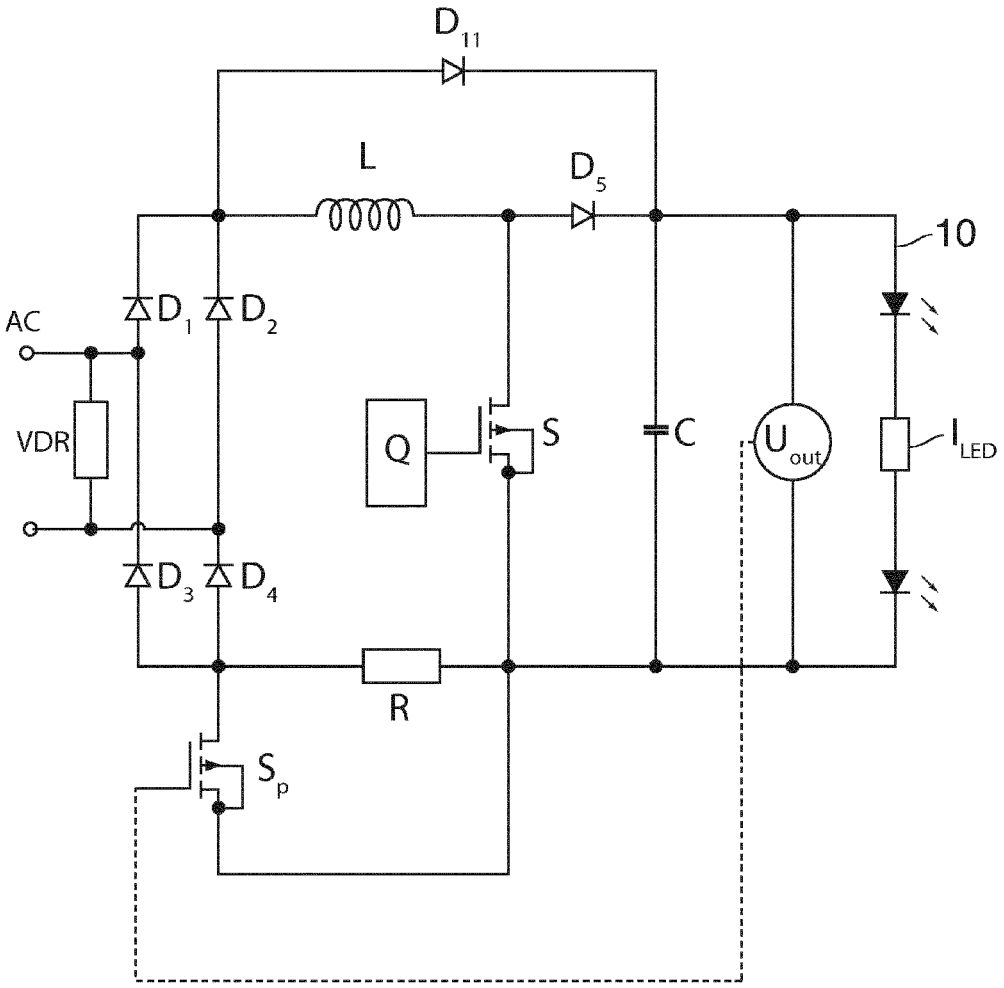
FIG. 7 is a circuit diagram comparable to FIG. 1, but illustrating measures for inrush current limitation and transient protection.

In all these embodiments, it will be preferable to provide additional measures for overvoltage protection and for limiting inrush currents. Examples are illustrated in FIG. 7 for the simple case of a single-level converter. The same concepts may be applied equivalently for the multi-level converters.

In order to limit inrush currents, a resistor R is interposed between the switch S and the rectifier diode bridge. A protector switch $S_p$ is connected in parallel to the resistor R. This protector switch $S_p$ is switched on and off dependent upon the measured output voltage $U_{out}$. When the system is powered-on, and the capacitor 10 has to be charged, the switch $S_p$ is off, so that the current will be limited by the resistor R. Only when the output voltage $U_{out}$ has reached its operating level the switch $S_p$ will be closed to short-circuit the resistor R, so that the converter may operate as has been described before.

Further, in order to prevent the inductor L from becoming saturated, a diode $D_{11}$ is connected in parallel to the inductor L and the diode $D_5$.

In addition, FIG. 7 shows a voltage dependent resistor VDR connected between the terminals of the mains voltage, so that any possible voltage transients may be suppressed (overvoltage protection). During an overvoltage transient, the switch Sp will be opened and the converter will be stopped. The resistor R is placed in series with the LED load to limit the peak current and protect the LEDs during the transient.

What is claimed is:

1. An LED driver circuit comprising:

at least one string of light emitting diodes (LEDs) connected in series, and a power supply for converting a mains voltage into an output voltage to be applied to said at least one string of LEDs, the power supply including a single-stage boost converter adapted to directly convert the mains voltage into the output voltage, wherein the boost converter is a multi-level converter having a switch and a capacitor respectively associated with each level, the capacitors of the various levels being connected in series, and a respective said string of LEDs being connected in parallel with each of the capacitors, wherein the converter includes an inductor and further comprising a controller adapted to operate the switches in a critical discontinuous mode, in which a current flowing through the inductor of the converter is allowed to drop to zero only momentarily, wherein the converter is adapted to generate, across each of the capacitors, a terminal voltage that is of the same order of magnitude or smaller than the peak level of a rectified mains voltage, and wherein the controller has a first mode of operation in which the switches are opened simultaneously and closed simultaneously, and at least one further mode of operation in which at least one switch is switched ON during an OFF period of at least one other switch.

2. The driver circuit according to claim 1, wherein the output voltage is larger than a peak level of the mains voltage.

3. The driver circuit according to claim 2, wherein the output voltage is at least 1.5 times the peak level of the mains voltage (AC).

4. The driver circuit according to claim 1, wherein the controller is adapted to switch, when an instantaneous value of the rectified mains voltage is smaller than the terminal voltage, to a mode of operation in which at least one of the switches is ON at any time.

5. The driver circuit according to claim 1, wherein the controller is adapted to switch, when an instantaneous value of the rectified mains voltage is larger than the terminal voltage, to a mode of operation in which at least one of the switches is OFF at any time.

6. The driver circuit according to claim 1, wherein the controller is adapted to control the duty cycles of the switches independently of one another.

7. The driver circuit according to claim 1, wherein the controller is adapted to control the switches such that the ON periods have a constant length, irrespective of an instantaneous value of the rectified mains voltage.

8. The driver circuit according to claim 1, further comprising an inrush current limitation circuit.

9. The driver circuit according to claim 1, further comprising an overvoltage circuit.

10. An LED driver circuit comprising:

at least one string of light emitting diodes (LEDs) connected in series, and a power supply for converting a mains voltage into an output voltage to be applied to said at least one string of LEDs, the power supply including a single-stage boost converter adapted to directly convert the mains voltage into the output voltage, and wherein the boost converter is a multi-level converter having a switch and a capacitor respectively associated with each level, the capacitors of the various levels being connected in series, and a respective said string of LEDs being connected in parallel with each of the capacitors, and wherein the converter has at least two inductors and a mode selector switch for switching the converter to a voltage multiplication mode in which each of the switches associated with the levels of the converter control only a current through one of the inductors.

* * * * *